US008911513B2

(12) United States Patent
Crosier et al.

(10) Patent No.: US 8,911,513 B2
(45) Date of Patent: Dec. 16, 2014

(54) BROWN GREASE SEPARATOR

(75) Inventors: Ronald L. Crosier, Lansing, WV (US); James E. Hendrixon, Nokomis, FL (US)

(73) Assignee: Downey Ridge Environmental Company, Lansing, WV (US)

( * ) Notice: Subject to any disclaimer, the term of this patent is extended or adjusted under 35 U.S.C. 154(b) by 946 days.

(21) Appl. No.: 12/849,899

(22) Filed: Aug. 4, 2010

(65) Prior Publication Data

US 2012/0030993 A1 Feb. 9, 2012

(51) Int. Cl.

| | |
|---|---|
| ***C10L 1/00*** | (2006.01) |
| ***C10L 8/00*** | (2006.01) |
| ***C10M 175/00*** | (2006.01) |
| ***C10L 1/02*** | (2006.01) |

(52) U.S. Cl.

CPC ..... *C10L 1/02* (2013.01); *C10M 175/0083* (2013.01); *C10M 175/0025* (2013.01)

USPC ..... 44/308; 44/639

(58) Field of Classification Search

CPC ..... C10L 1/02; C10L 5/363; C10L 5/44; C10L 9/00; C10L 9/86; C10M 175/0025; C10M 175/0083; C10M 2201/02; C10M 2201/08; C10M 2201/081; C10M 2201/082; C10M 2201/084; C10M 2201/105

USPC ..... 44/307, 605, 308, 639

See application file for complete search history.

(56) References Cited

U.S. PATENT DOCUMENTS

| | | | | |
|---|---|---|---|---|
| 4,445,638 | A * | 5/1984 | Connell et al. | 237/8 R |
| 2011/0197497 | A1* | 8/2011 | Jiang | 44/307 |

* cited by examiner

*Primary Examiner* — Ellen McAvoy
*Assistant Examiner* — Latosha Hines
(74) *Attorney, Agent, or Firm* — Nixon & Vanderhye PC

(57) ABSTRACT

A system and method are disclosed for processing grease trap waste to produce brown grease oil. Heat to promote waste grease stratification is provided by combustion of brown grease itself. A portion of the brown grease, which would normally be transported to an end user, is retained in a separate holding vessel at the grease processing site. The brown grease within the holding vessel is thermally conditioned to adjust viscosity so that it may be drawn through one or more pumps to increase pressure for atomization in a boiler. The heat of the brown grease combustion is applied to grease trap waste in the containment vessel by heating tubes immersed in the grease trap waste in which a heat transfer medium circulates and gives up its heat to the grease trap waste to thereby promote stratification of the grease trap waste and production of the brown grease oil.

26 Claims, 3 Drawing Sheets

BROWN GREASE SEPARATOR

The present invention relates to fuel oil production, and more particularly to a system and method for processing grease trap waste to produce a rich brown grease that can be used as an industrial fuel.

BACKGROUND OF THE INVENTION

In the processing of grease trap waste, the waste is typically loaded into a containment vessel configured to provide even heating of the waste so as to promote stratification of the waste into different layers. Heating of the waste is typically accomplished through the combustion of a petroleum based fuel, such as natural gas or light heating oil. The proper time and temperature relationship promotes stratification to form a bottom layer of mostly water. Directly above the layer of water will be a region containing food scrap residue. The top layer will consist of rich brown grease with viscosity, combustion, and heating value characteristics similar to the petroleum based product commonly known as Bunker 5, Bunker 6 or Heavy Fuel Oil. Typically, the brown grease layer is extracted to a separate storage vessel for transport to the end user.

BRIEF DESCRIPTION OF THE INVENTION

One object of the present invention is the processing of grease trap waste to attain water that would have lower levels of FOG (fats, oil and grease). This water could then easily be treated, and thus be disposable to local sewage plants.

Another object of the present invention is to produce a marketable, rich brown grease oil A further object of the present invention is to use the renewable rich brown grease as the only fuel source for the grease trap waste processing.

In the present method and apparatus for processing grease trap waste to produce rich brown grease oil, the heat to promote waste grease stratification is provided by combustion of the brown grease oil itself. A portion of the heavy brown grease, which would normally be transported to the end user, is instead retained in a separate holding vessel at the processing site and combusted by a boiler. The brown grease within the holding vessel is thermally conditioned to adjust viscosity so that it may be drawn through a pump or series of pumps to increase pressure for atomization through a small nozzle. The nozzle atomizes, meters and creates a spray pattern to maintain the combustion of the brown grease with the aid of a spark generating mechanism and the appropriate combustion air flow. Combustion byproduct gases are vented from the area. The heat of brown grease combustion is applied to the grease trap waste containment vessel in close proximity to the combustion process itself by a heat transfer medium transferred between the boiler and the grease trap waste containment vessel. The grease trap waste containment vessel contains at least one set of heating tubes in which the heat transfer medium circulates and which run through the containment vessel, so as to be immersed in the grease trap waste stored in the containment vessel. The grease trap waste in the containment vessel is heated by the heat transfer medium circulating in the heating tubes giving up its heat to the grease trap waste. The present system and method allow the production of rich brown grease without the direct combustion of a petroleum based product to promote waste grease stratification.

DETAILED DESCRIPTION OF THE INVENTION

Figure 1:
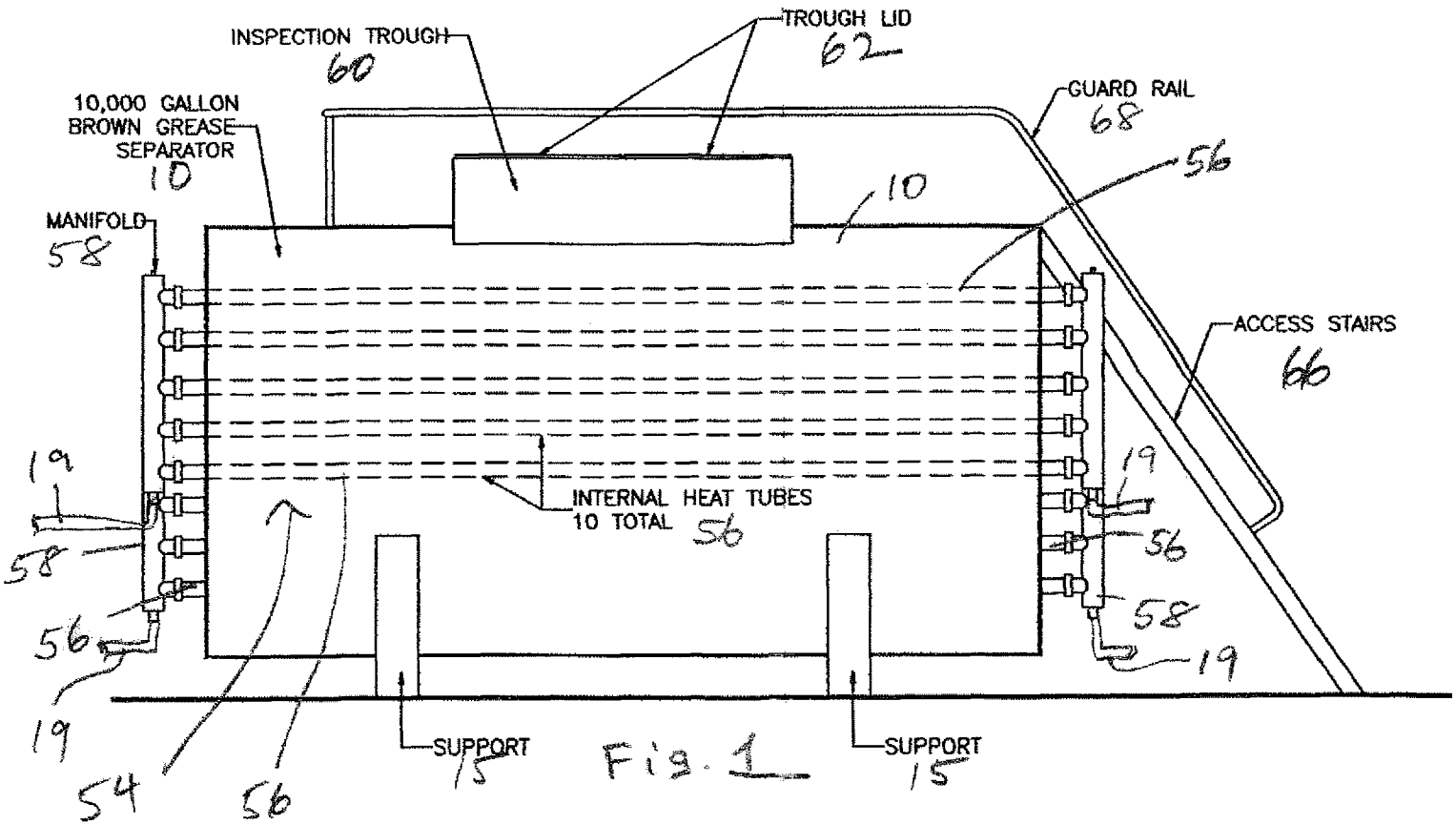
FIG. 1 is a front elevational view of a tank used to separate brown grease.
Figure 2A:
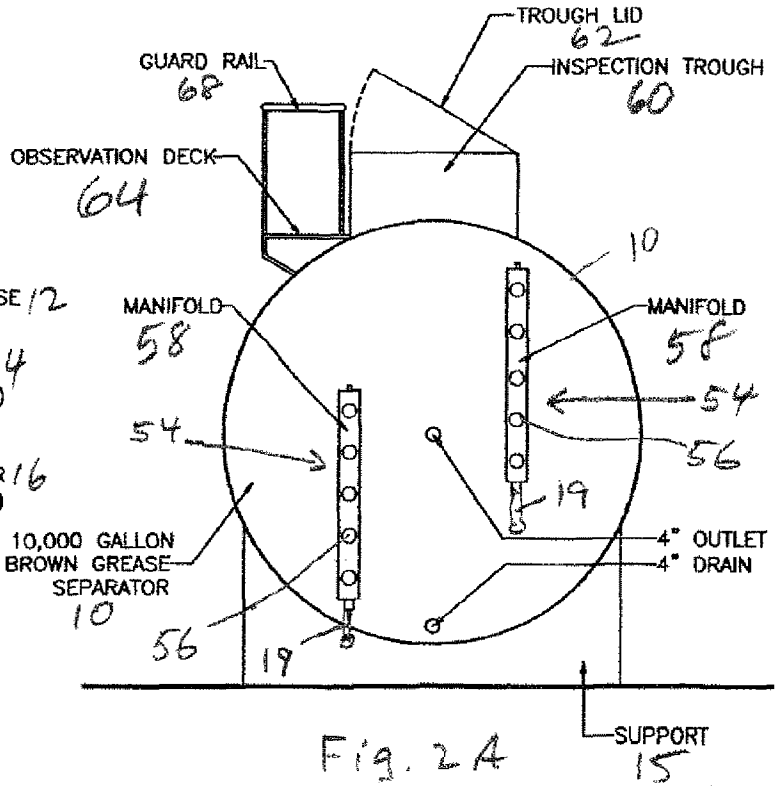
FIG. 2A is a left side elevational view of the brown grease separator tank.
Figure 2B:
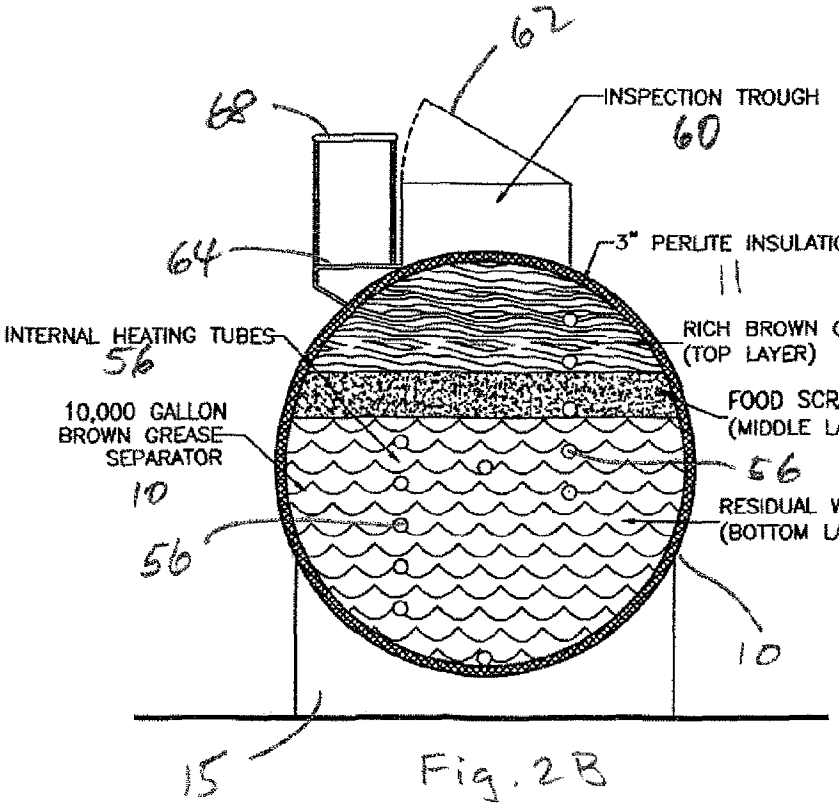
FIG. 2B is a left side cross-sectional view of the brown grease separator tank.

The present invention is directed to a system and method for processing grease trap waste to produce rich brown grease oil. For this purpose, the grease trap waste is placed in a holding tank or other vessel 10 that also serves as a separator tank or vessel in which the grease trap waste is separated into rich brown grease 12, food scrap 14 and residual water 16. FIGS. 1 and 2A are front and side elevational views, respectively, of the tank 10 used to separate brown grease, while FIG. 2B is a left side cross-sectional view of the brown grease separator tank 10. Tank 10 is preferably an insulated tank capable of holding a large volume of waste. In the embodiment of holding tank 10 shown in FIGS. 2A and 2B, three inch perlite insulation 11 is used to insulate tank 10, which has the ability to hold 10,000 gallons. Preferably, holding tank 10 is generally cylindrical in shape and resting on at least two supports 15. The tank 10 can be a commercially available tank that can be purchased "off the shelf". However, this "off the shelf" tank will typically require modification to add at least tubes 56, manifolds 58 and an inspection trough 60 discussed below. It should be noted that, besides a cylindrical shape, other shapes can be used for tank 10.

Figure 3:
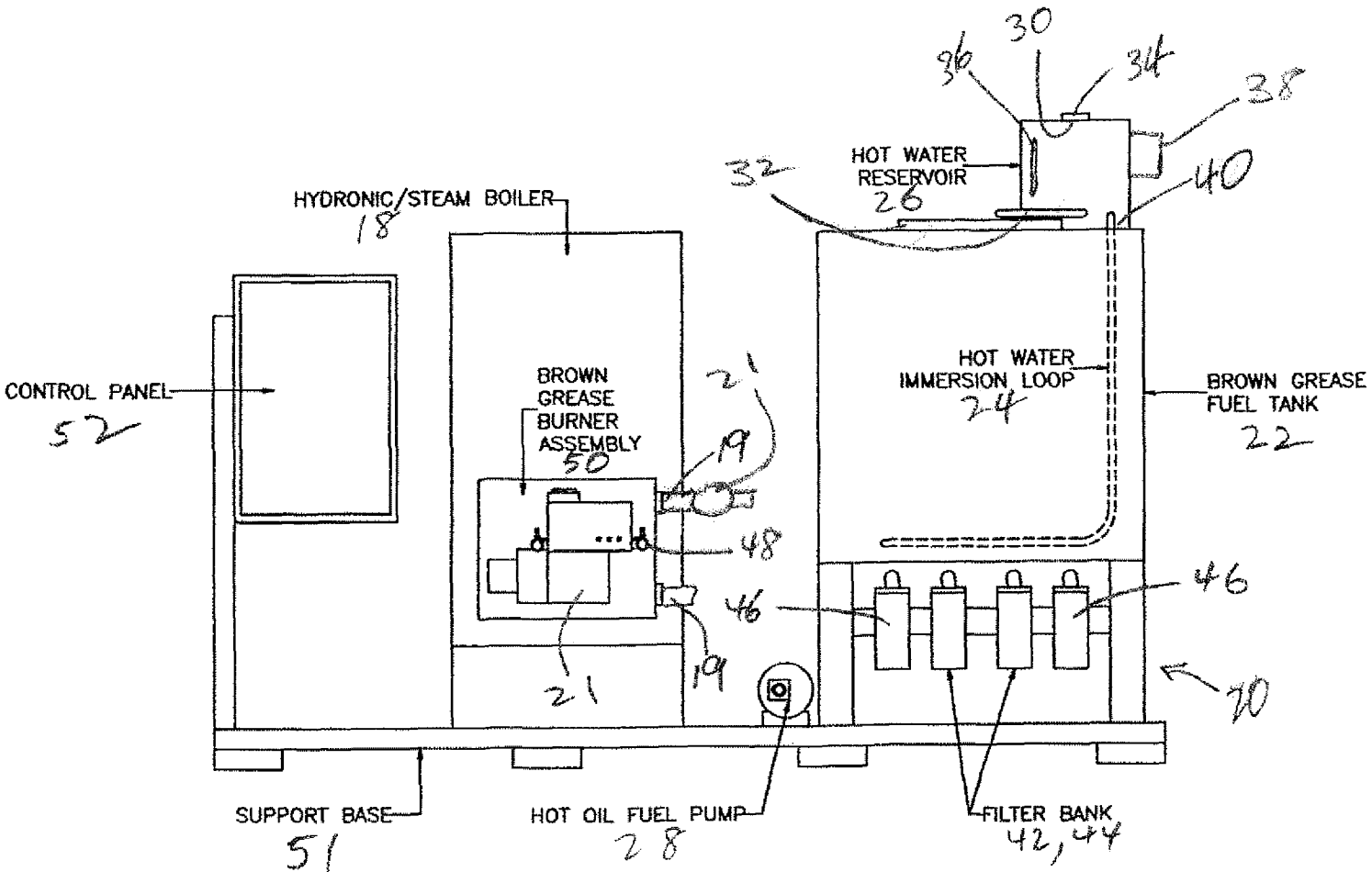
FIG. 3 is a front elevational view of heat and fuel equipment that is part of the brown grease separator system.

The system of the present invention preferably includes a hydronic steam boiler 18 and a fuel system 20 for pumping the brown grease oil. A hydronic steam boiler typically uses circulating hot water or steam as the heat-transfer medium in heating. It should be noted that, other suitable heat-transfer media could be used. FIG. 3 is a front elevational view of the hydronic steam boiler 18 and the fuel system 20 that form the heat and fuel equipment that is used by the brown grease separator system. The hydronic steam boiler 18 can be a commercially available boiler that can be purchased "off the shelf".

The fuel system 20 includes an insulated fuel tank 22 in which is stored brown grease fuel. Preferably, the fuel tank 22 is made of Stainless Steel. Within the fuel tank 22 is an immersion pipe or loop 24 that functions to transfer heat to the brown grease to thermally condition the grease. The immersion pipe or loop 24 is mounted inside and near the bottom of the fuel tank 22. A second, smaller tank 26, which is a hot water reservoir, is mounted on top of the fuel tank 22. Preferably, the hot water reservoir 26 is insulated.

The hot water reservoir 26 has a fill opening 30, a lower outlet 32, an inlet fitting 34 and a sight gauge 36. The lower outlet 32 of the hot water reservoir is connected to the inlet of a commercial electric water heater 38. The water heater outlet is connected to the inlet of a hot water circulation pump (not shown). The outlet of the hot water circulation pump is connected to the inlet 40 of the immersion pipe or loop 24 in the fuel tank 22. The outlet of the immersion pipe or loop 24 is connected to an inlet fitting (not shown) on the hot water reservoir 26. This arrangement forms a heat cycle for heating the brown grease oil stored in the fuel tank 22 so that it can be thermally conditioned.

The fuel system 20 also includes two sets of two manifold fuel filter units 42 and 44 constituting a total of four filters 46 and a heavy duty gear drive hot oil fuel pump 28 that will deliver a continuous oil flow of five gallons per minute ("GPM").

The grease stored in the fuel tank 22 is thermally conditioned by hot water circulating through the immersion pipe or loop 24 to thereby adjust its viscosity so that it may be drawn through the hot oil fuel pump 28 or series of pumps to increase pressure for atomization of the hot brown grease oil through a small nozzle 48 located in the hydronic steam boiler 18. The hot brown grease oil flows from the oil fuel tank 22 to one set 42 or 44 of the fuel filters 46, and then on to an inlet (not shown) of the hot oil fuel pump 28. The outlet (not shown) of the pump 28 then sends the hot oil to a second set 42 or 44 of the fuel filters 46, and then on to the burner assembly 50 within the hydronic steam boiler 18. Installed at the connection to the burner 50 is a return line (not shown) with a gauge and needle flow valve (not shown). This allows a constant regulated hot oil flow returning to the fuel tank 22 and supplies fuel on demand to the burner assembly 50 of the boiler 18. Constant return of the oil to the fuel tank 22 allows a true thermal conditioning of the brown grease. If the boiler were to cycle off at high temperature, the fuel would stop and cool, reverting to a gel/lard consistency, and would not re-establish flow, when the boiler was cycled back on by the boiler controls.

The operation of the hydronic steam boiler 18 and the fuel system 22 is controlled by a control panel 52 preferably located in the vicinity of the boiler 18 and fuel system 22. The control panel typically includes controls for emergency shut down, "on/off" of the boiler power, "on/off" of the fuel pump, and "on/off" of the fuel heat. Preferably, the hydronic steam boiler 18, the fuel system 22 and the control panel 52 are located on a support base 51.

The hydronic steam boiler 18 and fuel system 22 are preferably operated "continuously" by control panel 52, that is, 24 hours a day, 7 days a week. Preferably, the fuel tank 22 is operated at a temperature of approximately 105 to 115 degrees Fahrenheit. This temperature is measured at the outlet of fuel tank 22. Preferably, the grease waste holding tank 10 is operated at a temperature of approximately 140 degrees to 180 degrees Fahrenheit. This temperature is important to achieving stratification of the grease trap waste in the holding tank 10, which starts at about 100 degrees Fahrenheit. The temperature of holding tank 10 is monitored at control panel 52. The temperature controls to maintain the noted temperatures in the fuel tank 22 and the holding tank 10 are standard system controls that can be purchased "off the shelf".

The hydronic steam boiler 18 and fuel system 20, together, form a highly dependable boiler system that can operate completely on brown grease and be used to produce additional brown grease that can be used as a fuel oil. Thus, the boiler system formed by the hydronic steam boiler 18 and fuel system 20 is used to separate grease trap waste and provide a marketable, rich brown grease.

The heat of the brown grease being combusted in the hydronic steam boiler 18 is applied to the grease trap waste stored in the holding tank 10, in close proximity to the combustion process itself, by a heat transfer medium that is heated in the hydronic steam boiler 18 and then transferred from the boiler 18 to the holding tank 10 by an appropriate conduit arrangement, which is preferably a piping system 19 running between the boiler 18 and the tank 10 for moving a heat-transfer medium between the boiler 18 and the tank 10.

Hydronic steam boiler 18 preferably uses circulating hot water or steam as the heat-transfer medium for heating the grease trap waste stored in the holding tank 10. For this purpose, as shown in FIGS. 2A AND 2B, holding tank 10 preferably contains at least one set 54 of heating tubes 56 that run through the process holding tank 10, so as to be immersed in the grease trap waste stored in holding tank 10. The tubes are all connected to corresponding manifolds 58, which, in turn, are connected to the piping system running between the hydronic steam boiler 18 and the storage tank 10. Preferably, heated water or steam is transferred from hydronic steam boiler 18 to a first manifold 58, which then distributes the heated water or steam to the tubes 56 which are connected to it, and which are immersed in the grease trap waste stored in tank 10. The heated water or steam that is circulating in the tubes 56 serves to heat the grease trap waste by giving up its heat to the grease trap waste. Thereafter, the cooled water or condensed steam in the tubes 56 resulting from the heated water or steam giving up its heat to the grease trap waste passes to a second manifold 58, through which the cooled water or condensed steam then returns to the hydronic steam boiler 18 for further heating. Where heated water is used, the water is circulated between the boiler 18 and the tank 10 preferably by means of a circulator pump 21. Where steam is used, the steam is circulated from the boiler 18 to the tank 10 preferably by means of the pressure of the steam, and the condensed steam is returned from the tank 10 to the boiler 18 preferably by means of pitched pipes that allow gravity to eventually take the condensed steam back to the boiler 18.

Preferably, holding tank 10 includes at least one set 54 of four immersion tubes 56, more preferably, two sets 54 of four immersion tubes 56, and most preferably, two sets 54 of five immersion tubes 56 running through it, providing a total of ten immersion tubes. Where there is one set 54 of immersion tubes 56, preferably, the immersion tubes 56 are positioned generally in the center of tank 10, although it should be noted that the tubes 56 could be located in other positions within tank 10. Where there are two sets 54 of immersion tubes 56, preferably, the immersion tubes 56 are positioned, such that one set 54 is generally located on one side of the tank 10 in the lower part of the tank 10, while the second set 54 of tubes 56 is generally located on the other side of the tank 10 in the upper part of the tank 10. The "five high/five low" arrangement of the tubes 56 in tank 10 allows all layers in tank 10 to heat more evenly. It has been found that the tubes 56 should be immersed in the grease layer 12 because grease will not heat well above hot water. The grease almost acts like an insulator, so the tubes 56 are kept to the side of inspection trough 60, out of the way.

The one set of four immersion tubes has been found to be very effective in sufficiently heating the grease trap waste stored in holding tank 10. Two sets of four immersion tubes provide a more satisfactory result in heating the grease trap waste in holding tank 10. The most satisfactory result in heating the grease trap waste is provided by the two sets of five immersion tubes. Preferably, each of the tubes 56 in the sets 54 of immersion tubes is four inches in diameter and 21 feet long and connected to the other tubes in the set by a six inch manifold 58. The four inch diameter, 21 foot long tubes 56, and the number of such tubes 56, are sized and numbered to provide "sufficient" heating of the amount of grease trap waste capable of being stored in a 10,000 gallon tank, such as storage tank 10. The dimensions and/or number of the tubes 56 in tank 10 could be reduced where the size of the storage tank 10 is reduced. The boiler 18 shown in FIG. 3 is about an 800,000 BTU per hour boiler; so it is of a size that can practically heat the ten tube 56 arrangement shown in FIGS. 1, 2A and 2B.

The holding tank 10 also includes an inspection trough 60, which is also used to inspect, filter and/or harvest the rich brown grease 12. The inspection trough 60 is located on top of the storage tank 10. Preferably, for the 10,000 gallon tank shown in FIGS. 2A and 2B, the inspection trough 60 is two feet tall, four feet wide, and eight feet long, and welded into top of the tank 10. The inspection trough 60 includes a lid 62 to cover, and thereby close, the trough 60.

By heating the grease trap waste in the separator tank 10 to a temperature between 140-180 degrees Fahrenheit and then allowing it to rest for a period of 6 to 12 hours, stratification or separation is accomplished. Three distinct layers are formed, i.e., the bottom layer of residual water 16, the upper mid layer of food debris 14 and the top layer of rich brown grease 12.

Adjacent to the inspection trough 60, also on top of the tank 10, is an observation deck 64 by which an operator can inspect the contents of tank 10 to determine whether the grease trap waste heated in the separator tank 10 has stratified into the layers of residual water 16, food debris 14 and brown grease 12. To allow an operator to reach the observation deck 64, an access stairs 66 is provided. Also provided for safety reasons is a guard rail 68 that extends around the observation deck 64 and along side the access stairs 66.

The rich brown grease layer 12 in tank 10 is harvested after separation as a hot, brown grease oil. The hot grease oil has a viscosity similar to that of a 20W motor oil. This "grease oil" has viscosity, combustion, and heating value characteristics similar to the petroleum based Bunker 5, Bunker 6 or Heavy Fuel Oil discussed in the background section above. However, the grease oil is fat based, not petroleum based. After removal from tank 10, the hot grease oil is filtered and then pumped either to the brown grease separator fuel equipment for refilling either the fuel tank 22 of the boiler 18 and/or a nearby insulated holding tank, which could be a road transport trailer ready for market.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A system for processing grease trap waste to produce brown grease fuel oil, the system comprising:

a vessel in which the grease trap waste is stored and separated into layers of brown grease, food scrap and water, a heating system that heats the grease trap waste in the vessel, the heating system being comprised of a boiler and a burner assembly within the boiler that operates on brown grease fuel and a conduit arrangement for transferring a heat transfer medium between the boiler and the vessel, and a fuel system for supplying the brown grease fuel to the heating system, the fuel system being comprised of a fuel tank in which the brown grease fuel is heated so that the brown grease fuel has a viscosity that allows it to be combusted in the boiler burner assembly, the conduit arrangement including a plurality of tubes positioned within the grease trap waste in the vessel through which the heat transfer medium gives up heat to the grease trap waste to thereby heat the grease trap waste for separating the waste into the layers of water, food debris and brown grease.

2. The system of claim 1, wherein the vessel in which the grease trap waste is stored is a holding tank.

3. The system of claim 1, wherein the vessel in which the grease trap waste is stored is a holding tank that is substantially cylindrical in shape.

4. The system of claim 1, wherein the conduit arrangement is a piping system running between the boiler and the vessel that serves to move the heat-transfer medium between the boiler and the vessel.

5. The system of claim 1, wherein the boiler is hydronic steam boiler.

6. The system of claim 1, wherein the heat-transfer medium is hot water or steam.

7. The system of claim 1, wherein the brown grease fuel stored in the fuel tank is heated to a temperature of approximately 105 to 115 degrees Fahrenheit.

8. The system of claim 1, wherein the fuel system is further comprised of a hot water reservoir connected to a pipe loop immersed in the brown grease fuel stored in the fuel tank, the pipe loop carrying hot water that functions to transfer heat to the brown grease fuel to thermally condition the grease to thereby adjust its viscosity so that it can be combusted in the boiler.

9. The system of claim 8, wherein the hot water reservoir is connected to an electric water heater.

10. The system of claim 4, wherein the vessel includes at least one set of tubes that run through the vessel, so as to be immersed in the grease trap waste stored in the vessel, the tubes being connected to corresponding manifolds, which, in turn, are connected to the piping system running between the boiler and the vessel.

11. The system of claim 10, wherein the at least one set of tubes includes four immersion tubes.

12. The system of claim 4, wherein the vessel includes two sets of tubes.

13. The system of claim 12, wherein each set of tubes includes five immersion tubes.

14. The system of claim 12, wherein each set of tubes includes four immersion tubes.

15. The system of claim 11, wherein the set of immersion tubes is positioned substantially in the center of the vessel.

16. The system of claim 12, wherein one set of tubes is located substantially on one side of the vessel, in a lower part of the vessel, and the second set of tubes is located substantially on the other side of the vessel, in an upper part of the vessel.

17. The system of claim 1, wherein the vessel includes an inspection trough for inspecting the grease trap waste is stored and separated in the vessel and for filtering and harvesting the brown grease.

18. The system of claim 1, wherein the water is a bottom layer in the vessel, the food debris is an upper mid layer in the vessel, and the brown grease is a top layer in the vessel.

19. The system of claim 8, wherein the viscosity of the brown grease is adjusted so that it can be drawn through a hot oil fuel pump to increase pressure for atomization of the brown grease through a nozzle in the boiler.

20. The system of claim 8, wherein the fuel system is further comprised of a first set of fuel filters connected between the fuel tank and a fuel pump and a second set of fuel filters connected between the fuel pump and the burner assembly within the boiler.

21. The system of claim 1 further comprising a control panel for operating the boiler and the fuel system.

22. The system of claim 1 further comprising an inspection trough for inspecting, filtering and/or harvesting the brown grease in the vessel.

23. The system of claim 1, wherein the vessel in which the grease trap waste is stored is heated to a temperature of approximately 140 degrees to 180 degrees Fahrenheit.

24. The system of claim 23, wherein the vessel in which the grease trap waste is stored is, after the vessel has been heated to a temperature of approximately 140 degrees to 180 degrees Fahrenheit, then allowed to rest for a period of approximately 6 to 12 hours, to thereby achieve separation of the waste into the layers of water, food debris and brown grease.

25. A system for processing grease trap waste to produce brown grease fuel oil, the system comprising:

a tank in which the grease trap waste is stored and separated into layers of brown grease, food scrap and water, a heating system that heats the grease trap waste in the tank, the heating system operating with brown grease fuel, and a fuel system for supplying the brown grease fuel to the heating system, the heating system being comprised of a hydronic steam boiler, a burner assembly within the boiler that operates on brown grease fuel and a piping arrangement for transferring a heat transfer medium between the boiler and the tank, the fuel system being comprised of a fuel tank that stores the brown grease fuel and a hot water reservoir connected to a pipe loop immersed in the brown grease fuel stored in the fuel tank, the pipe loop carrying hot water that functions to transfer heat to the brown grease fuel to thermally condition the grease to thereby adjust its viscosity so that it can be combusted in the boiler burner assembly, the piping arrangement including a plurality of tubes positioned within the grease trap waste in the tank through which the heat transfer medium gives up heat to the grease trap waste to thereby heat the grease trap waste for separating the waste into the layers of water, food debris and brown grease.

26. A system for processing grease trap waste to produce brown grease fuel oil, the system comprising:

a vessel in which the grease trap waste is stored and separated into layers of brown grease, food scrap and water, a heating system that heats the grease trap waste in the vessel, the heating system being comprised of a boiler and a burner assembly within the boiler that operates on brown grease fuel and a conduit arrangement for transferring a heat transfer medium between the boiler and the vessel, a fuel system for supplying the brown grease fuel to the heating system, the fuel system being comprised of a fuel tank in which the brown grease fuel is heated so that the brown grease fuel has a viscosity that allows it to be combusted in the boiler burner assembly, the conduit arrangement including a plurality of tubes positioned within the grease trap waste in the vessel through which the heat transfer medium gives up heat to the grease trap waste to thereby heat the grease trap waste for separating the waste into the layers of water, food debris and brown grease, and a connection between the vessel and the fuel system through which a part of the separated brown grease is pumped from the vessel to the fuel system to refill the fuel tank.

* * * * *